United States Patent [19]

Chang

[11] Patent Number: 4,635,658

[45] Date of Patent: Jan. 13, 1987

[54] MODIFIED FIXING MEANS FOR COMB BRISTLES

[76] Inventor: Che-Yuan Chang, P.O. Box 10160, Taipei, Taiwan

[21] Appl. No.: 675,413

[22] Filed: Nov. 27, 1984

[51] Int. Cl.[4] ..... A45D 44/18

[52] U.S. Cl. ..... 132/85; 15/187

[58] Field of Search ..... 132/84 R, 85; 15/186, 15/187, 188

[56] References Cited

U.S. PATENT DOCUMENTS

| | | | |
|---|---|---|---|
| 196,167 | 10/1877 | Poland | 15/187 |
| 1,518,480 | 12/1924 | Buchanan | 15/186 |
| 1,957,363 | 5/1934 | Snell | 15/186 |
| 2,390,633 | 12/1945 | Anderson | 15/186 |
| 2,795,807 | 6/1957 | Salvy | 15/187 |
| 3,167,799 | 2/1965 | McKinley | 132/85 |
| 3,651,532 | 3/1972 | Wettburg | 15/186 |
| 4,118,823 | 10/1978 | Axelrod | 15/186 |
| 4,307,739 | 12/1981 | Chern | 132/85 |
| 4,479,501 | 10/1984 | Chern | 132/85 |

*Primary Examiner*—Michael H. Thaler

[57] ABSTRACT

A modified fixing assembly for comb bristle includes a bristle base formed with a first set of several fixing holes, a fixing frame formed with a second set of several fixing holes corresponding to the fixing holes on the base, a comb body having a recessed back portion and several fixing bolts each having an inversed truncated cone portion wherein each fixing bolt is inserted into both sets of fixing holes of the fixing frame and bristle base to assemble the base and frame together as locked by the truncated cone portion of the fixing bolt, and whereby the base combined with the frame are then fixed into the comb body easily and fastly.

2 Claims, 4 Drawing Figures

MODIFIED FIXING MEANS FOR COMB BRISTLES

BACKGROUND OF THE INVENTION

When assemblying a bristle base, a fixing frame and a comb body by the aid of adhesive, a conventional comb can be formed. However, the adhesive is easily cured to reduce the binding strength between the assembled parts of the comb, to thereby cause the comb broken or damaged during its use. If forming a comb by fixing the bristle base and fixing frame by nails, a skilled worker is required to fix each nail precisely on a fixing frame to waste much time. For example, one comb worker may only fix about 500 to 700 pieces of nails per day. If the fixing operation is not carefully done, the frame will be beaten to cause damage and increase the rejection rate on a production line.

The present inventor has found the defects of conventional combs and invented the present modified means for fixing bristle base on a comb.

SUMMARY OF THE INVENTION

The object of the present invention is to provide a modified fixing means for comb bristles by using a fixing bolt having an inversed truncated cone portion which will pass through two sets of fixing holes respectively formed on the fixing frame and the bristle base to assemble the frame and bristle base together which, in turn, is inserted into the comb body to form a final comb easily and fastly.

DETAILED DESCRIPTION

Figure 1:
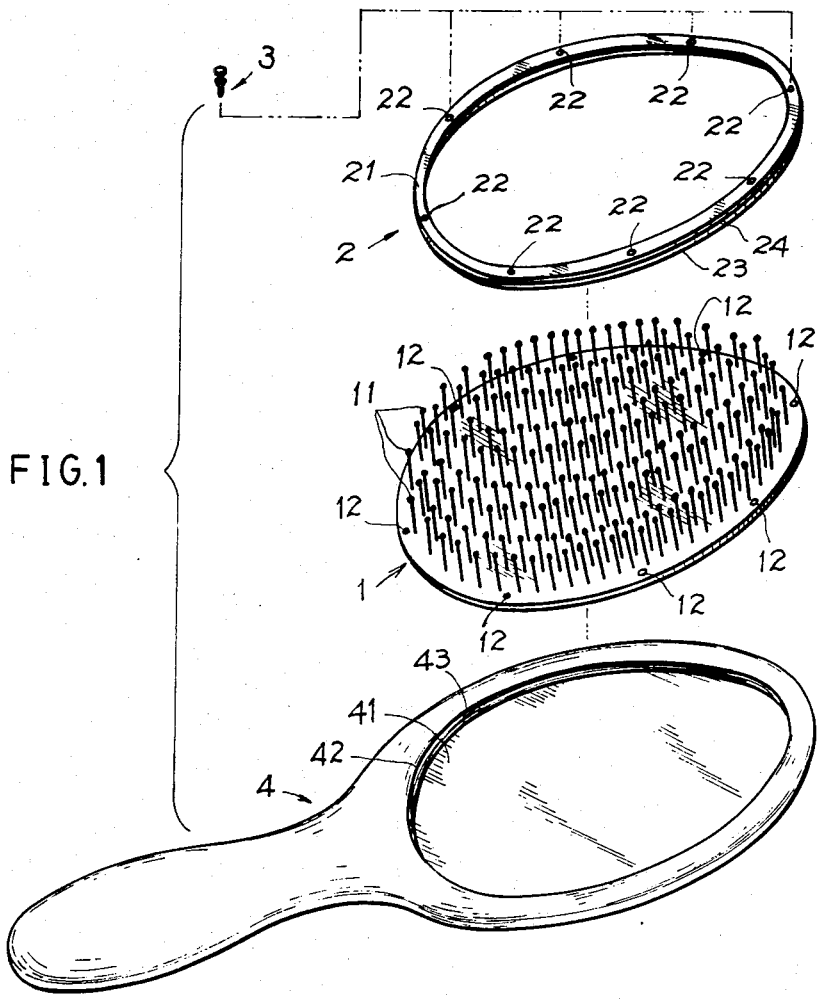
FIG. 1 is a perspective drawing showing all parts forming the present invention.
Figure 2:
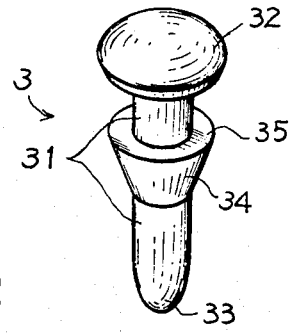
FIG. 2 is a perspective drawing of the fixing bolt of the present invention.
Figure 3:
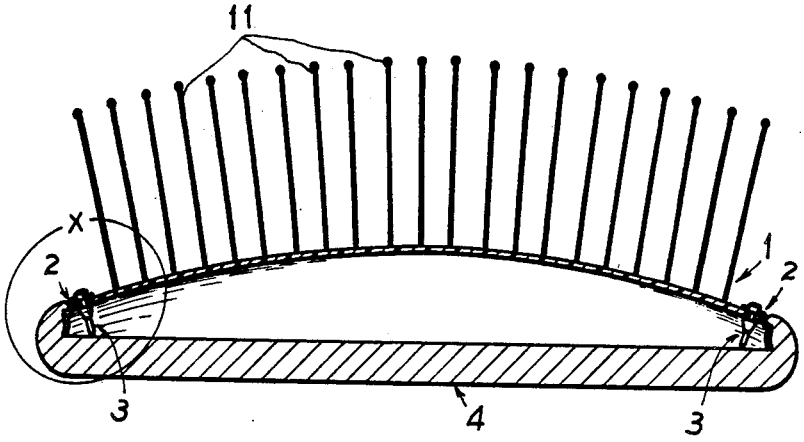
FIG. 3 is sectional drawing showing the assembled comb of the present invention.

As shown in the figures, the present invention comprises a bristle base 1, a fixing frame 2, several fixing bolts 3, and a comb body 4.

Bristle base 1 is made of yielding material and is formed with a plurality of bristles 11 on the base and formed with a first set of several fixing holes 12 along the periphery of base 1. Fixing frame 2 includes an upper rim surface 21 on which the second set of several fixing holes 22 are drilled to correspond the fixing holes on base 1, a side rim edge 23 bent downwards from upper rim surface 21 and a ratchet extension 24 formed on the lower portion of side rim edge 23.

Fixing bolt 3 comprises a shank portion 31, a head 32 formed on the top portion of shank 31, a round tip 33 formed on the lowest portion of shank 31 and an inversed truncated cone portion 35 intermediate the shank 31 and the tip 33. The cone portion 34 is expanded upwards to form a shoulder portion 35 on its top edge. Comb body 4 is formed with a recessed back portion 41, a recessed periphery 42 disposed on the periphery of recessed back portion 41, and an embedding groove 43 further recessed from the recessed periphery 42.

The ratchet extension 24 is engaged with the embedding groove 43 of comb body 4. The diameter of shank

Figure 4:
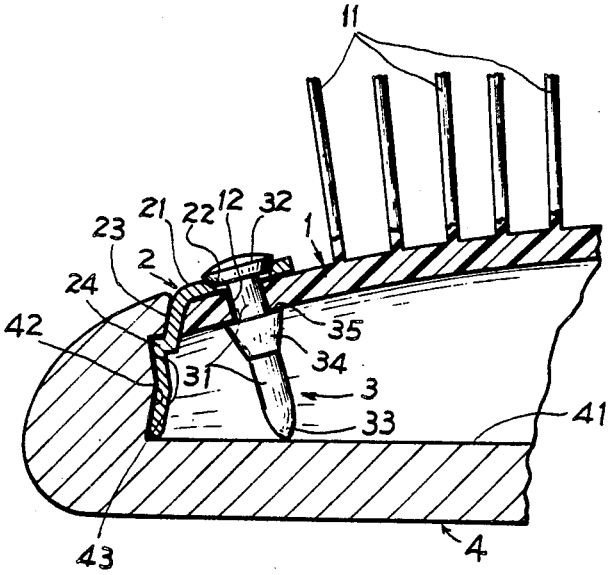
FIG. 4 is an enlarged sectional illustration fram X portion of FIG. 3.

31 of fixing bolt 2 is the same as that of hole 12 of base 1. The diameter of shoulder portion 35 is slightly larger than that of hole 12, but slightly smaller than that of hole 22 of frame 2. The diameter of head 32 is slightly larger than that of hole 22 so that after inserting bolt 2 into holes 12, 22, head 32 will stop on hole 22 and seal the hole 22. The length between shoulder portion 35 and head 32 is equal to the thickness of base 1 and the total length of shank 31 should be large enough to be inserted into the space between base 1 and back portion 41 as shown in FIG. 4.

When assembling the present invention, the fixing bolt 3 is inserted into two sets holes 22, 12 to protrude the inversed truncated cone portion 34 under hole 12 to firmly assemble fixing frame 2 and bristle base 1 as locked by the shoulder portion 35. The combination of frame 2 and base 1 is then put into comb body 4 by engaging ratchet extension 24 with the embedding groove 43. After poking the bolt tip 33 to touch the back portion 41, the bristle base 1 and frame 2 will be stably held on body 4.

the present invention has the following advantages in comparison with the conventional comb:

1. By using the present invention, the rejection rate for making comb can be much reduced.

2. Since there is no need to employ the skill workers for making the comb of the present invention, the production cost will be greatly reduced.

I claim:

1. A modified fixing means for comb bristles comprising:

a bristle base formed with a plurality of bristles on said base and formed with a first set of several fixing holes along the periphery of said base, said base being made of yielding material for inserting a fixing bolt through each fixing hole;

a fixing frame having an upper rim surface formed with a second set of several fixing holes corresponding to said fixing holes on said bristle base, a side rim edge bent downwards from said upper rim surface and a ratchet extension formed on the lower portion of said side rim edge;

several fixing bolts each assembling said fixing frame and said bristle base; and a comb body having a recessed back portion, a recessed periphery disposed on the periphery of said recessed back portion and an embedding groove further recessed from said recessed periphery, the improvement which comprises:

said fixing bolt including a shank portion having the same diameter as that of said fixing hole of said bristle base, a head formed on the top portion of said shank, a round tip formed on the lowest portion of said shank and an inversed truncated cone portion intermediate said shank and said tip, said inversed truncated cone portion expanded upwards to form a shoulder portion whose diameter is slightly larger than that of said shank and larger than said fixing hole on said bristle base, but slightly smaller than the diameter of said fixing hole on said fixing frame, said head having a diameter slightly larger than that of said fixing hole on said fixing frame, whereby said fixing bolt is inserted into both said fixing holes of said fixing frame and said bristle base to assemble said base and said frame together as locked by said inversed truncated cone portion of said bolt, and the combination of said base and said frame is then inserted into said recessed back portion of said comb body to form a comb easily and fastly by engaging said ratchet extension of said fixing frame with said embedding groove of said comb body.

2. A modified fixing means according to claim 1, wherein the length between said shoulder portion and said head of said fixing bolt is equal to the thickness of said bristle base.

* * * * *